United States Patent [19]

Letourneur et al.

[11] 4,065,019

[45] Dec. 27, 1977

[54] FLUID-TIGHT ISOTHERMAL TANK FOR LIQUEFIED GAS

[75] Inventors: Jean-Claude Letourneur, Sainte Adresse; Pierre Jean, Montivilliers, both of France

[73] Assignee: GAZ-Transport, Paris, France

[21] Appl. No.: 712,965

[22] Filed: Aug. 9, 1976

[30] Foreign Application Priority Data

Aug. 22, 1975 France ..... 75.25965

[51] Int. Cl.[2] ..... B65D 25/18

[52] U.S. Cl. ..... 220/9 LG; 220/15; 114/74 A

[58] Field of Search ..... 114/74 R, 74 A, 74 T; 220/9 R, 9 A, 9 LG, 15; 52/573

[56] References Cited

U.S. PATENT DOCUMENTS

| | | | |
|---|---|---|---|
| 3,399,800 | 9/1968 | Gilles | 114/74 A |
| 3,485,409 | 12/1969 | Becker | 220/9 A |
| 3,670,917 | 6/1972 | Nishimaki | 220/9 LG |
| 3,896,961 | 7/1975 | Guilhem | 114/74 A |

*Primary Examiner*—George E. A. Halvosa
*Assistant Examiner*—D. W. Keen
*Attorney, Agent, or Firm*—Brisebois & Kruger

[57] ABSTRACT

An improvement in fluid-tight isothermal tanks for holding liquefied gas and comprising sealing barriers of thin metal alternated with heat insulating barriers, the edges of two sealing barriers which intersect at a corner of the tank being connected by a deformable ring having an L-shaped section, with each flange comprising a strip of the same metal as said barrier attached to a plurality of spaced modules of heat insulating material, and the ring being fastened to an external supporting structure by draw bolts passing through the spaces between the modules.

23 Claims, 6 Drawing Figures

FLUID-TIGHT ISOTHERMAL TANK FOR LIQUEFIED GAS

SUMMARY OF THE INVENTION

This invention relates to a fluid-tight isothermal tank integrated with the supporting structure of transporting means such as a ship, said tank comprising two successive sealing barriers, a primary sealing barrier in contact with the liquid product in the tank and a secondary sealing barrier, said sealing barriers being alternately interfitted between a primary thermal insulating barrier and a secondary thermal insulating barrier.

French Patent No. 1,438,330 describes tanks of this type for the transportation of liquefied gases, which are integrated into the supporting structure of a ship, and indicates that, near the transverse partitions of the ship, each of the primary and secondary sealing barriers are terminated by a rigid polygonal ring which is made of a composite angle iron comprising beams connected to each other by a fixed strip of the same metal as that of the plates constituting the primary and secondary sealing barriers. The assembly of these beams constituting the rigid composite ring is connected to the double hull of the ship by means of hangers positioned from point to point and attached to the structure of the ship. These rigid rings make it possible, on the one hand, to support the stresses developed by the cargo and on the other hand to resist the forces engendered by the thermal and mechanical stresses due to the temperature of the cargo and the deformation of the structure of the ship during navigation. The use of such rings gives general satisfaction but is relatively expensive because of the necessity of using hangers of complex structure made of stainless steel.

It is the object of the present invention to propose the use of a deformable ring which bears continuously on the subjacent thermal insulation barrier and consequently makes it possible to eliminate the hangers associated with the transverse rings of the above mentioned prior art. The deformable ring according to the invention is attached to the double hull of the ship by means of anchor bolts permitting the walls of the tank to support the thermal and mechanical stresses to which they are subjected during transportation. Since the ring is deformable, it adapts to the deformations to which the double hull of the ship is subjected while at sea.

It is accordingly an object of the present invention to produce a new article of manufacture constituted by a fluidtight and thermally insulated tank adapted for the storage and transportation of a liquid product and especially a tank integrated into the supporting structure of the transporting means, for example, a ship, said tank consisting of two sets of successive sealing and thermally insulating barriers, a primary assembly in contact with the product inside the tank and a secondary assembly between the primary insulating barrier and the supporting structure of the ship, at least the primary sealing barrier consisting of metallic plates welded at their edges which are bent toward the the inside of the tank and terminating at a corner of the supporting structure of the ship, for example, the zone connecting the longitudinal walls with a transverse partition, in a ring comprising two flanges at right angles to each other. This structure is characterized by the fact that the rings consist of a composite deformable angle member, the two surfaces of the flanges of the angle member which are turned toward the inside of the tank each consisting of a strip of the same metal as the plates constituting the primary sealing barrier, the plates positioned in alignment with each strip of metal being fixed thereto by welding. Each strip of metal is attached to substantially identical modules having the general shape of parallelopipeds which are short, longitudinally juxtaposed and regularly spaced from each other. The two flanges of the composite angle member are connected to each other by said two strips of metal with each of the modules constituting one flange of a composite angle iron held against the subjacent insulating barrier by means of anchor bolts fixed to the supporting structure of the ship, and the modules of one of the flanges bearing at one of its edges against the modules of the other flange of the angle member.

In a preferred embodiment of the invention the modules belonging to one flange of the composite angle member are held against the subjacent insulating layer by means of bolts which are positioned in the spaces separating two contiguous modules which are longitudinally juxtaposed. The ends of the bolts which are not connected to the supporting structure of the ship terminate between two contiguous modules of one flange of the angle member in a recess defined by two opposed notches in each of two contiguous modules. A gripping plate pierced along its axis and having substantially the shape and dimensions of the section of the recesses is inserted between the bottom of said recess and a locking nut which cooperates with the threaded end of the corresponding anchor bolt. The spaces between the juxtaposed modules belonging to a given flange of the composite angle iron are staggered with respect to the spaces between the juxtaposed modules of the other flange of the angle iron. The space which defines the distance between two successive modules of one of the flanges of the angle member is extended to permit the passage of an anchor bolt by a slot formed in the modules constituting the other flange of the angle member. In this case each slot is advantageously formed substantially in the median zone of an edge of the juxtaposed modules of one flange of the angle iron. The modules which are provided with slots comprise, on the zone of their longitudinal face in which this slot is formed, a shoulder constituting the bearing zone of said slotted modules against the edges of the juxtaposed modules of the other flange of the angle member. The sheet metal strip of each flange of the composite angle member is screwed near its two edges to the juxtaposed modules of that flange of the angle member. The two strips of sheet metal are attached and sealed together by means of an angle member of the same metal as the two strips of sheet metal. The adjacent edges of the two strips of sheet metal of a composite angle member are bent at right angles over the section of the corresponding modules. Each anchor bolt consists of a stud welded to the walls of the supporting structure of the ship and connected through a connecting socket to a threaded rod at its two ends.

In a first variation of the integrated tank according to the invention the primary and secondary insulating barriers consist of boxes, of wood for example, which contain a heat insulating product such as the one sold under the trademark "PERLITE". In this case, the two primary and secondary sealing barriers are made of metal plates and the periphery of each barrier terminates near the angle which a transverse partition forms with the longitudinal walls of the supporting structure of the ship in a ring such as the one above defined. In this embodiment the primary bolts, that is to say, the bolts adapted to attach the composite angle member forming the ring associated with the primary sealing barrier to the primary insulating barrier, are positioned parallel to secondary bolts which connect them to the same wall of the supporting structure of the ship. The row of secondary bolts is positioned between the corner which defines the angle of the supporting structure and the parallel row of the primary anchor bolts. A primary bolt connected to one of the walls of the supporting structure is positioned in the same plane as a secondary bolt attached to the other wall of the angle of said structure. The primary bolts each pass through the space separating two contiguous modules constituting the secondary composite angle member in the notched zone provided at the edge of said space. The plates of the secondary sealing barrier are pierced by holes adapted to pass the primary bolts, the sealing at the level of these holes being provided by a collar formed at the periphery of the connecting socket carried by the primary bolt, said collars bearing on the edge zones of the holes and being welded thereto. The insulating boxes form a corner row on which an angle member bears and are regularly spaced from each other to permit the passage of the anchor bolts, the intermediate spaces being filled, before the corresponding composite angle member is put in place, with a suitable insulating material, for example, rock wool. The boxes forming a corner row on which one flange of the angle member bears are each attached to that flange by means of screws screwed into the edge of the strip of sheet metal which is furthest from the corner formed by said angle member. The longitudinal faces of the modules constituting one flange of the angle member to which a strip of metal is attached have a notched edge the depth of which notch corresponds substantially to the thickness of a connecting plate which is screwed thereto, said connecting plate bearing on tenons provided on the lateral transverse edge of boxes forming a row adjacent the corner row. The connecting plate is in alignment with the metal strip of the flange of the corresponding angle member and with the longitudinal face of the boxes forming the row adjacent to the corner row. The space between the corner row and the adjacent row is filled, before the connecting plate is put in position, with a thermal insulating material, for example, rock wool.

In a second embodiment of the integrated tank according to the invention, the primary and secondary insulating barriers are made of prefabricated blocks of plastic foam, which may be reinforced by glass fibers, positioned beside each other, and assembled in situ adhesively, the primary sealing barrier being connected to a deformable ring as above described, the primary heat insulating barrier comprising on the one of its surfaces on which a flange of the composite angle iron bears, a notch within which a reinforcing plate is adhesively secured. This plate may be made of wood and attached to said flange by means of a screw passing through the modules in the edge zone which is furthest from the corner of the angle member. The anchor bolts holding the primary ring against the supporting structure of the ship are made of stainless steel, glass fibers or resin, or of a plastic material reinforced with glass fibers.

In order that the object of the invention may be better understood two embodiments thereof will now be described, purely by way of illustration and example, with reference to the accompanying drawings, on which:

Figure 6:
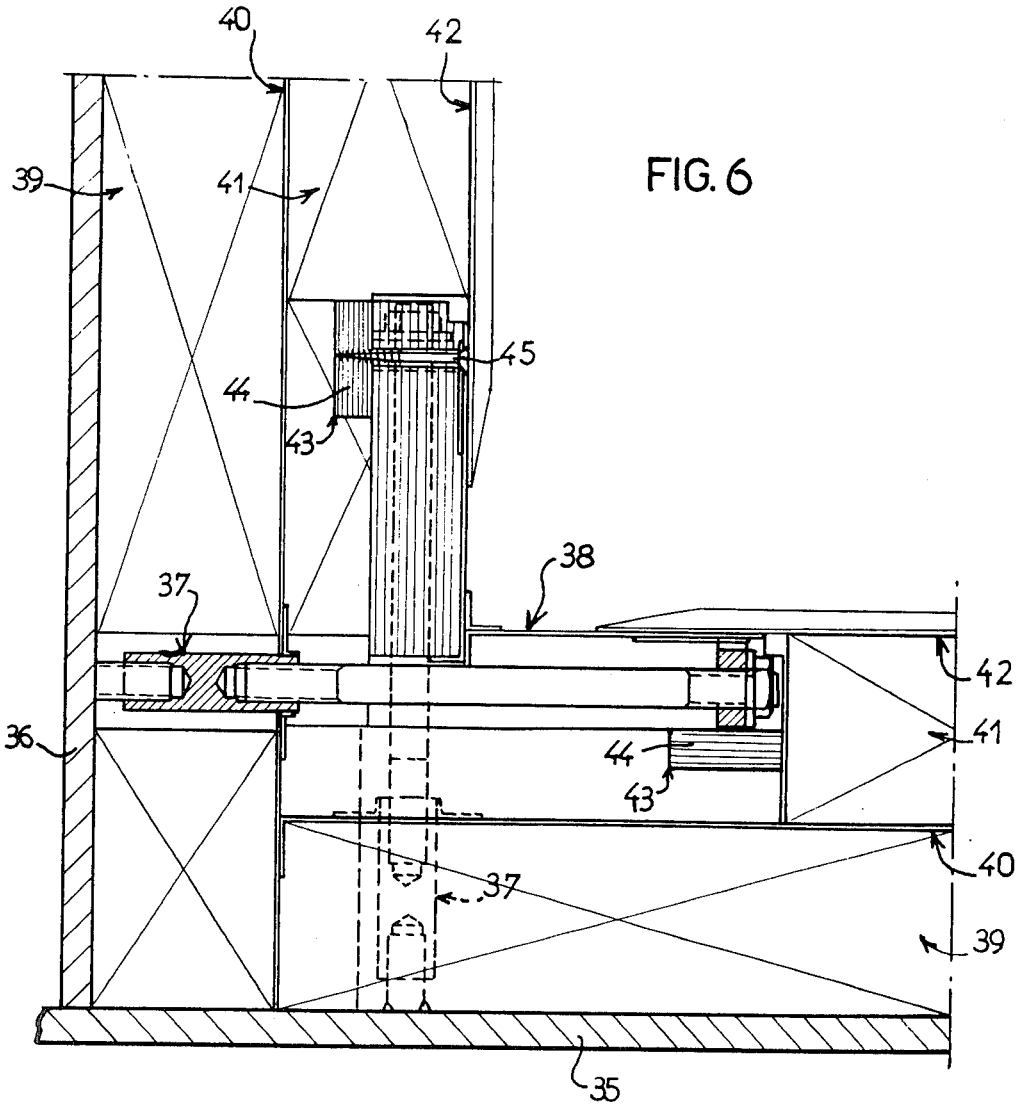
Figure 5:
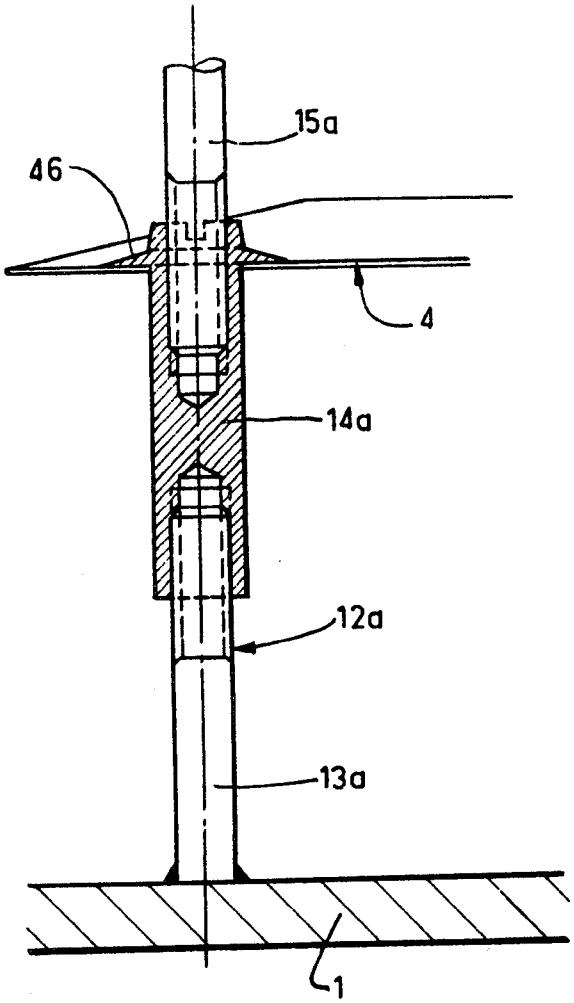

FIG. 5 is a detail view of another embodiment of the fluid-tight connections between the plates of the secondary sealing barrier and the primary bolts which pass therethrough; and FIG. 6 shows, in section, a dihedral angle at one corner of a second embodiment of an integrated tank according to the invention, in which embodiment the primary and secondary insulating barriers are made of plastic foam.

The two embodiments which have been described relate to a tank integrated into the supporting structure of a ship adapted to transport liquefied natural gas at low temperature. The structure of the ship which is illustrated consists, in these embodiments, of an inner wall 1 parallel to the floatation plane of a ship, and thus substantially horizontal, and constituting the bottom of the ship. This wall 1 is connected at right angles to a partition 2 which is substantially vertical and positioned perpendicular to the longitudinal axis of the ship. The same arrangement is maintained for the dihedral angle formed between the double hull of the ship and the partition 2.

In the embodiment illustrated in FIGS. 1 to 4 the secondary insulating barrier which covers the wall 1 and the partition 2 consists of wooden boxes 3 containing a particular insulating product sold under the tradename "PERLITE". The boxes 3 which are positioned outside the dihedral angle defined by the walls 1 and 2 are attached directly thereto, for example by means of threaded studs attached to these walls, the gas permeable boxes being positioned so as to define therebetween free spaces for permitting the free circulation of gas. In the zone of the dihedral angle the two rows of boxes 3 may be directly and adhesively secured to wall 1 and the partition 2.

On the stack of boxes 3 which constitute the secondary insulating layer which covers the wall 1 and the partition 2, a secondary sealing barrier 4 is positioned as described in French Patent No. 1,438,330 and consists of metallic plates made of Invar and welded by their flanges which extend toward the inside of the tank to the two surfaces of a metallic flange 5. The metallic flange 5 may be attached to the boxes 3 of the secondary insulating barrier by means of a sliding joint such as the one described in detail in French Patent No. 71-26652. On the secondary insulating barrier 4 is, in like manner, positioned a stack of boxes 6 constituting the primary insulating barrier, which is covered in a conventional manner, by a primary sealing barrier 7, which is in contact with the liquid inside the tank formed in this manner. The primary sealing barrier 7 is made of metallic plates welded by their flanged edges to the two surfaces of a metallic flange 8 made of Invar.

In the embodiment of FIGS. 1 to 4 the two secondary sealing barriers 4, one vertical and one horizontal, are connected, in the dihedral angle formed by the wall 1 and the partition 2, by means of a deformable ring 9. This ring bears continuously on the subjacent secondary insulating layer. In like manner the connection, along the dihedral angle, of two primary sealing barriers 7, which are vertical and horizontal, is made by means of a deformable ring 11. This ring is held against the boxes 6 of the primary insulating barrier by bolts 12 welded to the walls 1 and 2 of the supporting structure of the ship. These bolts 10 and 12 may be made of metal, a plastic material, or any other material having suitable mechanical properties. They comprise a short stud 13 welded perpendicularly to the wall of the supporting structure of the ship, a connecting socket 14 and finally a rod 15 threaded at its two ends. The studs 13 of the anchor bolts 10 and 12 are welded in place in a preliminary step before locating the boxes 3 on the walls 1 and 2 to form the secondary insulating barrier.

Figure 1:
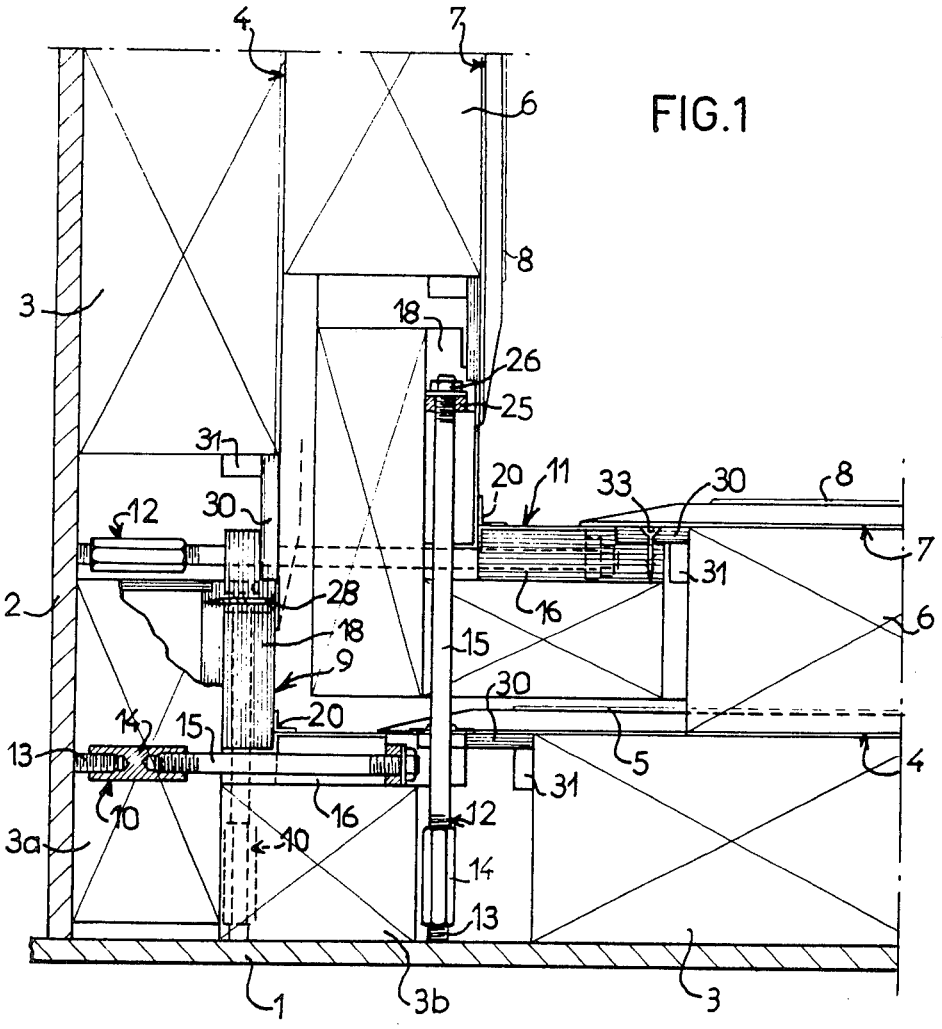
FIG. 1 is a sectional view taken through the dihedral angle at one corner of an integrated tank according to the first embodiment of the invention perpendicular to the planes forming said angle, said tank comprising two insulating barriers made of wooden boxes containing a particular heat insulating product.
Figure 2:
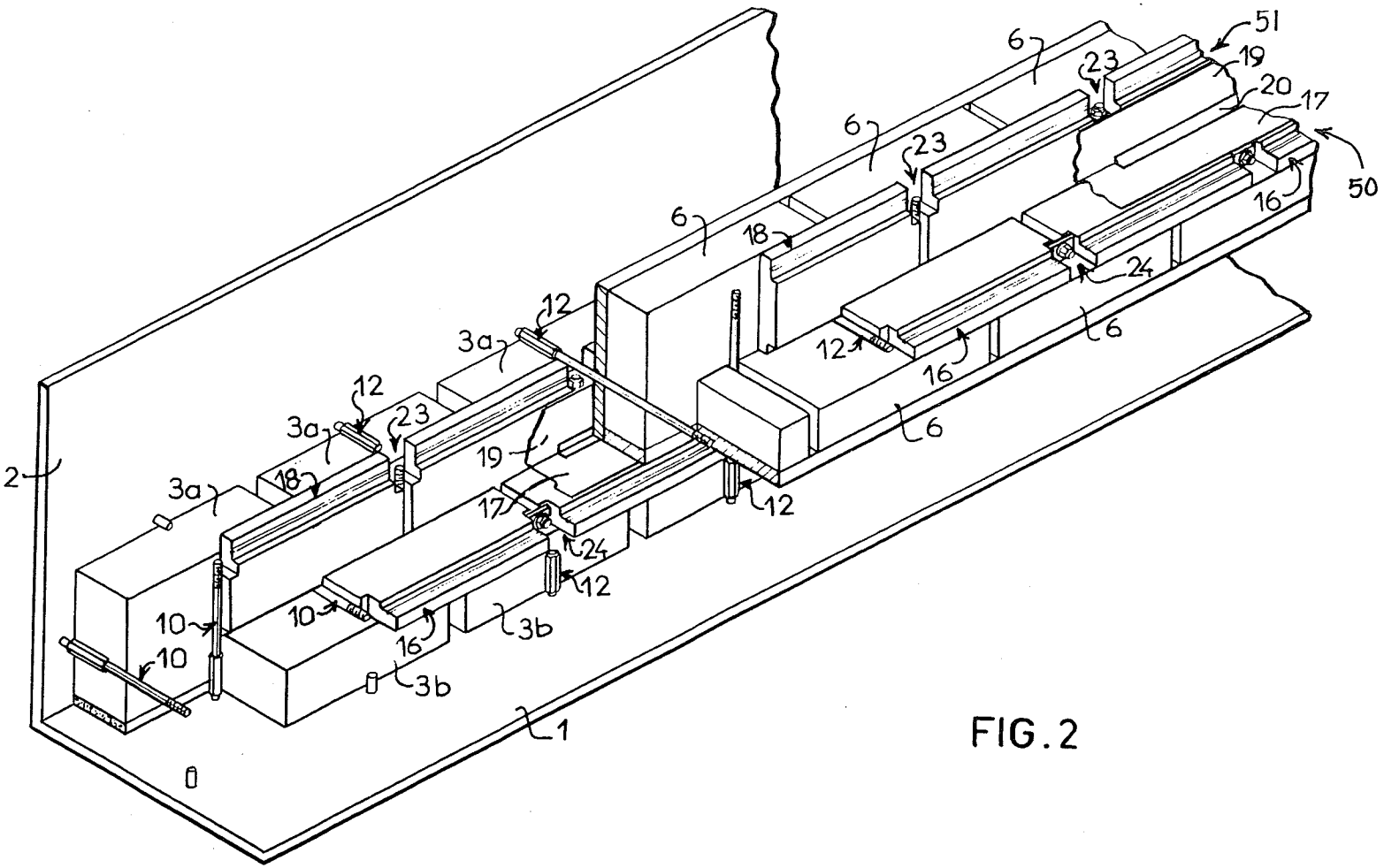
FIG. 2 is a perspective view, partially broken away, showing the components shown in FIG. 1.
Figure 3:
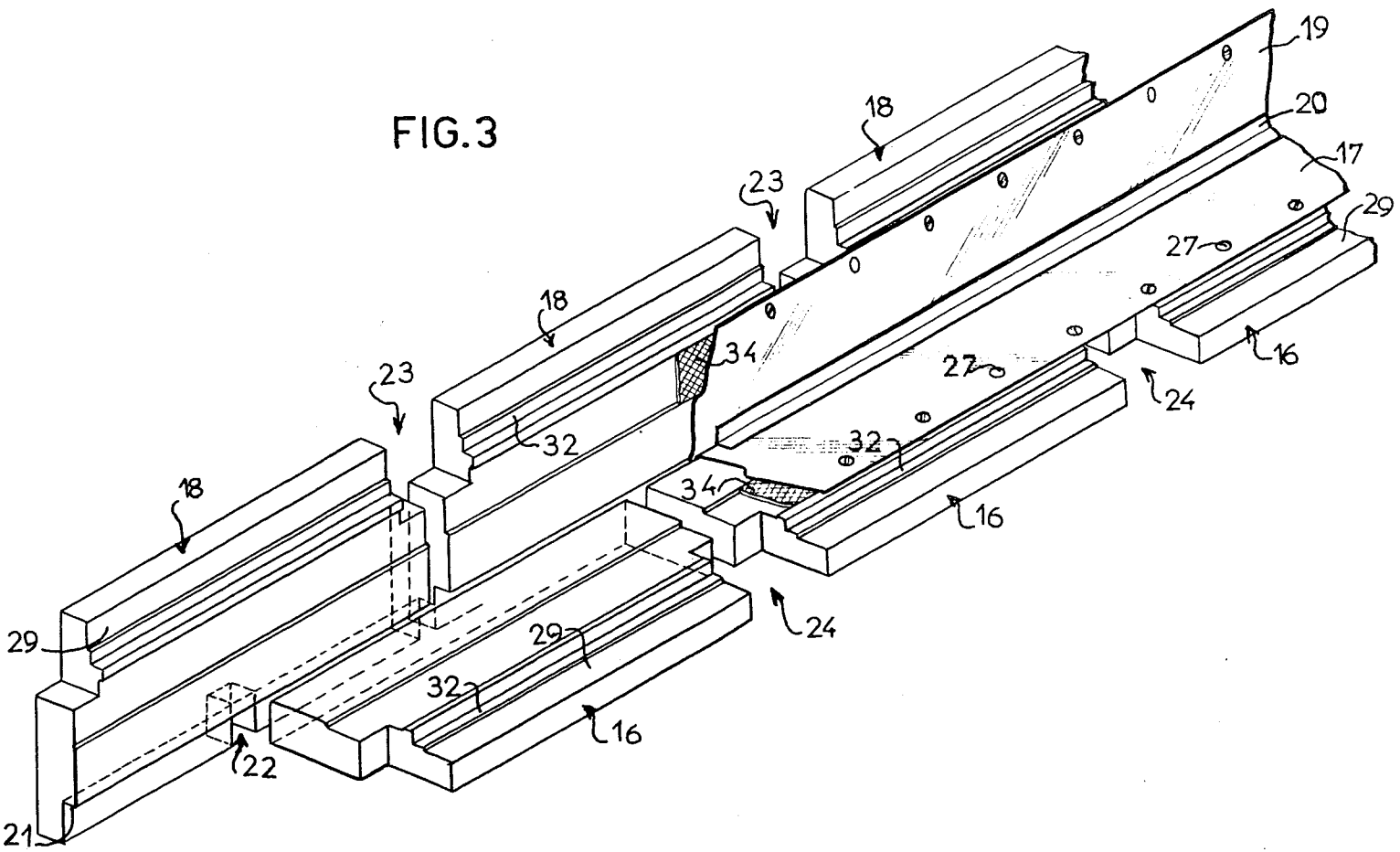
FIG. 3 is a perspective view, partially broken away, and on a larger scale, showing the components constituting one of the deformable rings formed of a composite angle member of FIGS. 1 and 2.
Figure 4:
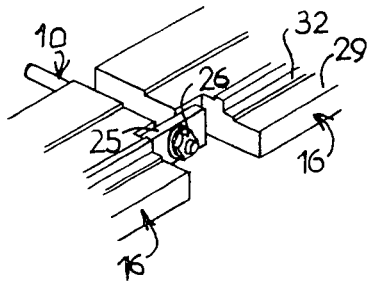
FIG. 4 shows, in perspective, a detail of the connection between the modules of one flange of the composite angle member of FIG. 3 and the anchor bolts.

FIG. 2 shows in detail the arrangement at a dihedral angle of the tank and the relationship between the different anchor bolts. A row of studs 13 is welded perpendicularly on the partition 2 and support the secondary anchor bolts 10, that is to say, the anchor bolts designed to urge the deformable ring 9 against the secondary vertical insulating barrier formed by the boxes 3. This alignment is substantially parallel to the wall 1 and the draw bolts 10 are regularly spaced from each other. A row of horizontal draw bolts 12 is also mounted perpendicularly on the vertical partition 2 at a higher level. These are used to hold the deformable ring 11 against the boxes 6 of the primary vertical insulating barrier. These bolts 12 are spaced from each other by a distance substantially equal to that between two contiguous draw bolts 10 perpendicular to the wall 2. On the horizontal supporting wall 1 is welded, beginning at the corner defined by the dihedral angle, a row of vertical draw bolts 10 spaced from each other by a distance equal to that between the horizontal draw bolts 12, each vertical bolt 10 being positioned in alignment with each horizontal bolt 12. A second row of vertical bolts 12 spaced from each other by a distance equal to that which separates two horizontal bolts 12 is also positioned on the wall 1 parallel to the row of vertical bolts 10. Each vertical bolt 12 is aligned with each horizontal bolt 10.

After having welded on the studs 13 of the various vertical and horizontal anchor bolts 10 and 12, a row of vertical boxes **3*a* is positioned in the dihedral angle formed by the supporting walls 2 and 1 against the vertical wall 2 and a row of horizontal boxes 3*b* on the horizontal wall 1. The boxes 3*a* and 3*b* may then be adhesively secured to the walls of the dihedral angle. The spacing of the horizontal anchor bolts 10 corresponds substantially to the length of a box 3*a* while the distance which separates a horizontal anchor bolt 12 from the wall 1 corresponds substantially to the height of a box 3*a*. In like manner the space between vertical anchor bolts 10 determines the length of the boxes 3*b* while the distance which separates the horizontal anchor bolts 10 from the plane of the wall 1 determines the height of the boxes 3*b***.

The deformable ring 9 which is adapted to bear against the boxes **3*a* and the boxes 3*b* consists of a composite angle member having a right angle section. This angle member 9 comprises a substantially horizontal flange formed from modules 16 which are relatively short and generally parallelopipedic in shape. Modules 16 are longitudinally juxtaposed and regularly spaced from each other. Each module 16 bears against two contiguous boxes 3*b* of the horizontal secondary insulating barrier. A strip of sheet metal 17, made of Invar, is screwed at its two edges to the module 16, thereby defining one flange 50 of the composite angle member 9. The vertical flange 51 of the composite angle member 9 comprises modules 18 having a shape and dimensions substantially identical to those of the module 16. The modules 18, like the modules 16, are made of laminated wood and are longitudinally juxtaposed and regularly spaced from each other, the spaces separating two successive modules 18 being staggered with respect to those of two modules 16. On the longitudinal surface of the modules 18 turned toward the inside of the tank, a strip of sheet metal (Invar) is also mounted by screwing its two edges to the modules. The two flanges of the composite angle member 9 are connected to each other by an auxiliary strip 20, bent at right angles, which is welded to the two sheet metal strips 17 and 19**.

Each of the modules 18 comprises, on the face covered by the sheet metal strip 19, and in the edge adjacent the modules 16, a groove defining a shoulder 21 which bears against the inner edge of the modules 16. The inner edge of the strip 19 is bent at right angles against the shoulder 21, to which it is screwed. In like manner, the inner edge of the sheet metal strip 17 which is bent at right angles is screwed to the groove in the horizontal modules 16.

The space between the ends of two contiguous modules 16 is prolonged in alignment with the modules 18 by a slot 22 having a rectangular right section which is formed in the wall of the modules 18. The notches 22 are positioned in the transverse median plane of the modules 18 and are adapted to permit the passage of the horizontal anchor bolts 10. All the bolts 10, whether vertical or horizontal, are positioned in the spaces between the ends of the modules of the composite angle member 9 and substantially in the longitudinal median plane of these modules. The vertical bolts 10 terminate in a recess 23 formed by two opposed notches in the upper transverse corners of the modules 18. The recess 23, having a right rectangular section, has a horizontal bottom constituted by the two edges of the notches. In the same manner the horizontal bolts 10 which pass through the spaces between two contiguous boxes 3, the notch 22 and the space between the ends of the two adjacent modules 16 enter a recess 24 having a shape and dimension identical to those of the recess 23.

In order to connect the composite angle member 9 to the supporting walls 1 and 2 of the structure of the ship by means of anchor bolts 10, a rectangular gripping plate 25 having substantially the shape and dimensions of the recess inside which it is placed is slipped on to the threaded end of the bolts 10. The plate 25 is brought into abutment against the bottom of the recess. The composite angle member 9 is then secured by means of a lock nut 26 against the subjacent secondary insulating barrier. The connection of the anchor bolt to the angle member module is more particularly shown on FIG. 4 of the drawings.

In order to better secure the modules of the composite angle member 9 against the subjacent secondary insulating barrier, holes 27 through the walls of the modules are first provided along the outer edges of the sheet metal strips 17 and 19. When the composite angle member 9 is put in place, screws 28 are introduced into the holes 27 and screwed into the wall of the subjacent boxes or into tenons formed into edges of these boxes.

Between the corner row of the boxes 3*a* and the adjacent row of boxes 3 which is positioned thereabove is a space in which the horizontal bolts 12 are located. This space is found between the row of boxes 3*b* and the row of boxes 3 which is immediately adjacent thereto and rests on the supporting wall 1. In order to insure continuous support, in alignment with these spaces, for the secondary sealing barrier 4, a notch 29 is provided on the modules in alignment with the sheet metal strips 17, 19. In the notches 29 of a single row of modules is located a connecting plate 30 which covers the intermediate space and bears on tenons 31 fixed to boxes 3 forming the row adjacent to the angle row. The connecting plate 30 is attached to the module of the angle member by means of screw 33. As the screws are inserted the connecting plate 30 acts as a lever on the tenons 31 by reason of the pressure which a rib 32 formed for this purpose in the notches 29 applies thereto. The plate 30 is advantageously in the form of a strip of laminated wood of great length so that it may be positioned as a sole tenon on several successive modules of one flange of an angle member. In this case holes are provided in the plate so as to permit the passage of anchor bolts 12 when it is put in place.

Since these connecting plates 30 are made of wood, which make it easy to rectify their dimensions, if necessary, during mounting on board ship, they permit very large mounting tolerances. Furthermore, they assure not only continuous support for the sealing barrier but also bridge the insulating boxes adjacent the dihedral angle.

The edges of the plates of the secondary sealing barrier 4 are welded to the strips of sheet metal 17 and 19. These edges cover the zone of the side of the strip of sheet metal in which the heads of the attaching screws are located, as is shown on FIG. 1 of the drawings. In order to avoid damaging the subjacent module during welding of the plates to the strips of sheet metal 17 and 19, a thermal protective strip 34 is inserted between the walls of the mdoule and the covering strip in the zone in which the edges of the plates are welded together.

The boxes 6, constitute the primary insulating layer which comprises, at the level of the dihedral angle, a layer of compensating material in which the metallic flanges 5 which serve to join the flanged edges of the plates of the secondary barrier are embedded.

The composite angle member 11 to which the two primary sealing barriers are welded is identical to that of the composite angle member 9 and for this reason the components constituting the composite angle member 11 have been designated by the same reference numerals as the corresponding components of the composite angle member 9. The angle member 11 is mounted against the subjacent primary insulating barrier in the same way by introducing vertical and horizontal anchor bolts 12. It will also be noted that the length of the corner boxes 6 which are to constitute the vertical barrier is determined by the distance between two successive horizontal draw bolts whereas the length of the corner boxes 6 which are to constitute the horizontal barrier is determined by the distance between two vertical and contiguous anchor bolts 12. All the vertical and horizontal anchor bolts 12 pass through the flanges of the composite angle member 9 via the recesses 23 and 24.

In the embodiment of FIGS. 1 to 4, the plates of the secondary sealing barrier are pierced by holes through which the horizontal and vertical primary draw bolts 12 pass. Fluid-tightness is assured by a washer welded both to the threaded rod 15 and to the plates of the secondary sealing barrier 4. FIG. 5 shows a variation in the construction of this sealing member. The primary draw bolt 12*a* comprises a connecting socket 14*a* provided with a collar 46, the outer diameter of which is greater than that of the passage holes. During mounting, after having placed the secondary sealing barrier 4 in place, which barrier is pierced by holes for receiving draw bolts 12, the sockets 14*a* are screwed onto the welded studs 13*a* until the collar 46 bears against the edge zone of the passage holes. The collar and the edge of the passage hole are then sealed together by welding.

It should be noted that all the spaces which exist between the boxes 3 and the boxes 6 are filled with an insulating material, such as rock wool for example, so as to permit the free circulation of gas.

FIG. 6 shows a second embodiment of a tank integrated with the supporting structure of a ship. The supporting structure of the ship consists, in this example, of an inner wall 35 parallel to the plane of flotation of the ship, which wall is connected at right angles to a partition 36 which is substantially vertical and transversely positioned with respect to the axis of the ship.

The horizontal wall 35 carries a row of anchor bolts 37 welded perpendicularly to said wall and parallel to the partition. In like manner, the vertical wall 36 carries a row of anchor bolts 37 welded and positioned horizontally and parallel to the partition. The vertical and horizontal anchor bolts 37 are adapted to connect the supporting structure of the ship to a deformable ring 38 constituted by a composite angle member. The primary vertical sealing barrier and the primary horizontal sealing barrier are connected as hereinbefore described to the composite angle member.

The secondary heat insulating barrier 39 is made of foam prefabricated plastic blocks reinforced by glass fibers. These foam blocks are positioned side by side and adhesively secured together. The secondary sealing barrier 40 consists of a layer of plastic material, for example glass cloth coated with resin. The primary insulating barrier 41 also consists of prefabricated blocks of plastic foam connected to each other adhesively. It should be noted that the blocks of plastic foam are adapted to be positioned in the neighborhood of the dihedral angle and may be first pierced by holes to permit the passage of the anchor bolts 37. Finally, the primary sealing barrier 42 is made as before, that is to say, from metallic plates made of Invar having flanged edges bent back toward the inside of the tank, the plates being welded flange to flange on the two surfaces of a metallic flange.

The construction of the composite angle member 38 is substantially identical to that of the angle members 9 and 11 hereinbefore described and will not consequently be hereinafter described in detail. The foam plastic blocks of the barrier 41 comprise a notch 43 on the face thereof on which a flange of the angle member 11 rests. In the notch 43 is adhesively secured a reinforcing plate 44 made of laminated wood. The reinforcing plate is attached to the flange of the angle member 38 by a screw 45 passing through the corresponding module and terminating in the vicinity of the edge of the strip of Invar which is remote from the corner of the composite angle member. This type of connection makes it possible to improve the pressure of the composite angle member on the subjacent primary insulating layer. Since there is no more space between the running in question and the dihedral, it is no longer necessary to provide, as in the embodiment of FIGS. 1 to 4, connecting members.

It is important to note that by reason of the elimination of the hangers which were necessary in the device of French Patent No. 1,438,330, the construction of the integrated tank is simplified and its cost reduced. The working time necessary to mount it is also reduced due to the use of connecting members made of laminated wood between the point in question and the dihedral of the tank.

It will of course be appreciated that the embodiments hereinbefore described have been given purely by way of illustration and example and may be modified as to detail without thereby departing from the basic principles of the invention.

What is claimed is:

1. In a fluid-tight thermal insulating tank for holding a liquid product, said tank comprising two sets of successive sealing and thermal insulating barriers, a primary set positioned to contact the product contained in the tank and a secondary set located between the primary insulating barrier and an external supporting structure, at least the primary sealing barrier comprising metallic plates having inwardly projecting flanged edges welded together and terminating at the intersection between two walls of the supporting structure in a deformable ring the improvement according to which said ring comprises; a composite deformable angle assembly, said angle assembly comprising, a first flange and a second flange, each flange comprising a plurality of generally parallelopipedic shaped modules, a facing surface including a strip of metal connected to and spacing said modules regularly and in a longitudinally juxtaposed arrangement, and connecting means for joining said facing surface of one of said flanges to the facing surface of the other of said flanges at essentially a right angle so that the modules of said one flange bear against the modules of the other said flange; and securing means connected between the angle assembly and the external supporting structure for holding said modules against the subjacent insulating barrier.

2. The tank of claim 1 wherein each said flange further comprises bolt accomodating means defined at least by the ends of two juxtaposed modules, and wherein said securing means comprises draw bolts passing through said bolt accomodating means.

3. Tank as claimed in claim 1 wherein two contiguous modules of a flange include notches formed opposite each other and defining a recess of predetermined dimensions and wherein said securing means comprise, a draw bolt including a locking nut and a threaded end, and a gripping plate substantially of the same dimensions as the recess for insertion into the recess and including a hole through which the threaded end passes, said locking nut being screwed onto the threaded end for securing the gripping plate between the locking nut and the bottom of the recess.

4. Tank as claimed in claim 1 in which the spaces between the juxtaposed modules of said first flange are staggered with respect to the spaces between the juxtaposed modules of said second flange, the space between two successive modules of one of said flanges defining a neighboring area on the other of said flanges, said area including a slot effectively an extension of the space to permit the passage of said securing means.

5. Tank as claimed in claim 4 in which each slot is formed substantially in the median zone of one edge of one of the juxtaposed modules of a flange.

6. Tank as claimed in claim 5 in which the one of said flanges which includes modules having slots comprises a first abutting edge section including a groove and in which the other of said flanges comprises a second abutting edge section, said groove receiving said second abutting edge section.

7. Tank as claimed in claim 1 in which each of said flanges further comprises attaching means, said attaching means comprising screws located near the edges of said strip of metal and passing through the metal into the modules for joining the strip to the modules and wherein the connecting means comprises an auxiliary strip welded to each said facing surface.

8. Tank as claimed in claim 1 in which the adjacent edges of each said strip of metal are bent at right angles over the edges of the modules to which each said strip of metal is joined.

9. Tank as claimed in claim 1 in which the modules comprise laminated wooden blocks.

10. Tank as claimed in claim 1 in which the securing means comprise draw bolts, each of said draw bolts comprising a stud welded to the wall of said supporting structure, a rod threaded at both ends, and a socket connected to said stud for receiving said rod.

11. A tank according to claim 1 in which the primary and secondary insulating barriers comprise boxes which contain thermal insulation.

12. Tank as claimed in claim 11 wherein the supporting structure includes a transverse partition and a longitudinal wall and in which the secondary sealing barrier comprises metallic plates, each barrier terminating at its edge near the intersection between the transverse partition and the longitudinal wall.

13. Tank as claimed in claim 12 in which the securing means comprise primary draw bolts connected in a row on a wall of the supporting structure for holding the composite angle member of the primary barrier against the primary insulating barrier and secondary draw bolts connected to the same wall of said supporting structure in a row parallel to the row of primary draw bolts, said secondary draw bolts securing the deformable ring for the secondary barrier and positioned between the intersection between two walls of the supporting structure and the parallel row of primary draw bolts.

14. Tank as claimed in claim 13 in which said primary and said secondary draw bolts are positioned on at least two intersecting walls and wherein at least one of said primary draw bolts is positioned in the same plane as at least one of said secondary draw bolts attached to the other intersecting wall of said structure.

15. Tank as claimed in claim 13 in which each of the primary draw bolts passes through the space separating two modules of the composite angle member of the secondary barrier.

16. Tank as claimed in claim 13 wherein said primary draw bolts comprise a stud connected to the supporting structure and a connecting socket connected between said stud and the primary barrier and wherein the plates of the secondary sealing barrier comprise bolt receiving means which permit the passage of primary draw bolts through said plates, each of said bolt receiving means comprising a collar on the periphery of the connecting socket, said collar bearing on the secondary sealing barrier and welded thereto.

17. Tank as claimed in claim 11 further comprising a corner row, said corner row comprising insulation boxes for supporting a flange of the angle assembly and regularly spaced from each other to permit the passage of draw bolts; and filler means for insulating the intermediate spaces between said blocks.

18. Tank as claimed in claim 17 further comprising box attaching means for securing the flange to the insulation boxes and including screws, said screws passing through the edge of the metal strip which is furthest from the right angle of the angle member and into the boxes.

19. Tank as claimed in claim 11 further comprising a transverse lateral wall of boxes and a corner row of boxes, said lateral wall adjacent the corner row, in which the longitudinal surfaces of consecutive modules of at least one flange of an angle member further comprises a recessed edge and a connecting plate, the depth of the recess corresponding essentially to the thickness of said connecting plate, said connecting plate secured in said recessed edge, said transverse lateral wall of boxes comprising a tenon, said connecting plate bearing on said tenon.

20. Tank as claimed in claim 19 in which the connecting plate is in alignment with the strip of metal of the flange of the corresponding angle member and the longitudinal surface of the transverse lateral wall of boxes.

21. Tank as claimed in claim 19 further comprising thermal insulating means for filling the space between the corner row and the adjacent row.

22. Tank as claimed in claim 1 in which the primary and secondary insulating barriers comprise prefabricated foam blocks of plastic material positioned side by side and adhesively assembled in situ.

23. Tank as claimed in claim 22 in which the primary thermal insulating barrier comprises facing means for supporting a flange of the composite angle member, said facing means including a groove and a reinforcing plate, said reinforcing plate adhesively secured within said groove and said plate attached to said flange by means of a screw passing through the modules in the edge furthest from the corner of the angle member.

* * * * *